US006963191B1

(12) United States Patent
McCalmont

(10) Patent No.: US 6,963,191 B1
(45) Date of Patent: Nov. 8, 2005

(54) SELF-STARTING REFERENCE CIRCUIT

(75) Inventor: Jonathan S. McCalmont, Ames, IA (US)

(73) Assignee: Micrel Inc., San Jose, CA (US)

( * ) Notice: Subject to any disclaimer, the term of this patent is extended or adjusted under 35 U.S.C. 154(b) by 189 days.

(21) Appl. No.: 10/683,845

(22) Filed: Oct. 10, 2003

(51) Int. Cl.[7] ..... G05F 3/16; G05F 1/10
(52) U.S. Cl. ..... 323/315; 327/543
(58) Field of Search ..... 323/312, 313, 323/314, 315, 317; 327/535, 537, 538, 539, 327/543

(56) References Cited

U.S. PATENT DOCUMENTS 4,412,186 A * 10/1983 Nagano ..... 330/288
4,935,690 A * 6/1990 Yan ..... 323/314
5,311,115 A * 5/1994 Archer ..... 323/315
5,780,904 A * 7/1998 Konishi et al. ..... 257/369
5,889,430 A * 3/1999 Csanky ..... 327/543
6,114,900 A * 9/2000 Yamaguchi ..... 327/541
6,188,270 B1 * 2/2001 Boerstler ..... 327/543
6,448,844 B1 9/2002 Cho

OTHER PUBLICATIONS

Allen & Holberg, *CMOS Analog Circuit Design*, Holt, Rinehart & Winston, New York, 1987, pp. 240-251.
Gray & Meyer, *Analysis and Design of Analog Integrated Circuits*, 3d Ed., John Wiley & Sons, Inc. New York, 1993, pp. 317-333.

* cited by examiner

*Primary Examiner*—Matthew V. Nguyen
(74) *Attorney, Agent, or Firm*—Fenwick & West LLP

(57) ABSTRACT

A reference circuit provides a reference electrical characteristic such as a current or voltage using a low-threshold field effect transistor (FET) for improved start-up operation. The use of a low-threshold FET eliminates a stable operating point from occurring at zero current allowing the elimination of additional startup circuitry thereby providing power and space savings, particularly in analog CMOS circuitry. Additionally, the use of a low-threshold FET allows a lower voltage requirement from the power supply providing additional power savings.

10 Claims, 5 Drawing Sheets

SELF-STARTING REFERENCE CIRCUIT

FIELD OF THE INVENTION

The present invention relates generally to systems and methods for generating a reference electrical characteristic, for example, a small bias current for the operation of analog circuits, in particular in the context of analog complementary metal-oxide semiconductor (CMOS) circuitry and Bi-CMOS circuitry.

BACKGROUND OF THE INVENTION

Ideally, a voltage or current reference circuit provides a stable voltage or current that is independent of power supply and temperature. Many applications in analog circuits require such a stable current or voltage. For example, a small bias current reference is typically required for operation of analog circuits such as comparators and operational amplifiers.

An example of a circuit used to generate such a reference current or voltage is a threshold voltage $V_t$ referenced source also known as a bootstrap reference. In such a reference circuit, the voltage across an active device creates a current that then controls the original current through the device to produce a current or voltage that is independent of the power supply voltage $V_{DD}$.

An example of a $V_t$ or bootstrap reference using all MOS devices (e.g. all CMOS devices) is the reference circuit 100 illustrated in FIG. 1 which represents a circuit including a reference circuit 120 and a start-up circuit 110. (See, for example, Allen & Holberg, CMOS Analog Circuit Design, p. 240–251, Holt, Rinehart & Winston, New York 1987, which is hereby incorporated by reference). The reference circuit 120 comprises a current mirror 134 including p-channel field effect transistors (FETs) M3 and M4, n-channel FETs M1 and M2, a reference regulator 136 implemented in this example as an n-channel FET M1 and a reference output regulator 138 implemented in this example as a resistance R. The sources of p-channel transistors M3 and M4 are connected to positive voltage supply $V_{DD}$. The drain of transistor M3 is connected to the gate of n-channel transistor M2 and also to the drain of n-channel transistor M1. The drain of p-channel transistor M4 is connected to the drain of n-channel transistor M2. The gates of transistors M3 and M4 are connected together. The drain of transistor M4 is also connected to the gates of transistors M3 and M4 so that the output voltage $V_{XP}$ is supplied to the gates. N-channel transistor M1 has its drain also connected to the gate of n-channel transistor M2, and its source connected to a ground $V_{SS}$. The source of transistor M2 is connected to the gate of transistor M1 and to one side of the resistance R. Another side of resistance R is connected to ground $V_{SS}$.

The p-channel transistors and the n-channel transistors form a feedback circuit which causes the current in n-channel transistor M1 to be the same current supplied to resistance R. In other words, the voltage $V_{GS1}$ appears as the voltage V across R. In post-start-up operation, the p-channel transistors M3 and M4 are assumed to be matched devices forming a current mirror unit producing equal currents, $I_1$ and $I_2$, to flow from the drains of M3 and M4. $I_1$ is referred to as the reference current, and $I_2$ as the mirrored output current or bias current. The reference current $I_1$ activates the gate of n-channel transistor M2 resulting in a voltage of $V_{XN}$. The output current $I_2$ having passed through transistor M2 flows through resistance R to generate voltage V which in turn provides gate voltage $V_{G1}$ to the gate of n-channel transistor M1 to activate or "turn on" transistor M1. In this example, transistors M1 and M2 are n-channel transistors fabricated to have a positive threshold voltage. For example, the fabrication process includes a positive threshold voltage adjustment implant. $I_1$ flows through transistor M1 creating the gate-source voltage $V_{GS1}$, and current $I_2$ flows through resistance R creating a voltage $V=I_2R$. Because the two voltages are connected together, an equilibrium operating point Q is established at $$I_2R = V_{t1} + \sqrt{\frac{2I_1}{K'_N}\frac{L_1}{W_1}}$$

wherein $V_{t1}$ is the threshold voltage for transistor M1, $W_1$ is the width of its active area, $L_1$ is the length of its active area, and $K'_N$ is the transconductance parameter for the n-channel transistor M1.

This equation can be solved iteratively for $I_1=I_2=I_Q$. Alternatively, $V_{GS1}$ can be assumed to be approximately equal to $V_{t1}$ so that $$I_Q = I_2 = \frac{V_{t1}}{R}.$$

Since $I_1$ or $I_2$ does not change as a function of $V_{DD}$, the sensitivity of $I_Q$ to changes in $V_{DD}$ is essentially zero.

Unfortunately, there are two possible equilibrium points in FIG. 1 at Q, one of which is undesired because it occurs at $I_1=I_2=0$. In FIG. 1, a problem comes about if M2 is turned off. This causes the voltage on the gates of M3 and M4 to go to $V_{DD}$, resulting in turning them off so that the forward active currents $I_1$ and $I_2=0$. M2 does not receive enough leakage current from M3 to overcome its positive threshold voltage requirement so it is turned off. Without the forward active currents, the voltage across R and gate voltage of transistor M1 go to zero, turning them off and resulting in the undesirable equilibrium point at zero current.

In order to prevent the circuit from remaining at the undesired point, a start-up circuit such as the example 110 is necessary. The start-up circuit 110 comprises a resistance RB, a n-channel FET M7, and another n-channel FET M8. The resistance $R_B$ is connected to $V_{DD}$ on one side, and the other side of resistance $R_B$ is connected to the gate of n-channel FET M7 and to both a drain and a gate of n-channel FET M8. Transistor M7 has its drain connected to $V_{DD}$, its gate connected to the other side of resistance $R_B$ as well as the drain of transistor M8, and its source connected to the drain of transistor M3, the drain of transistor M1 and the gate of transistor M2. The source of transistor M8 is connected to ground $V_{SS}$.

The gate of transistor M7 is activated by the voltage across $R_B$ so that a forward active current flows from the source of M7 to the gate of transistor M2 causing M2 to "turn-on." M2 would draw current $I_2$ from the drain of M4 and generate a voltage across R, which in turn activates the gate of M1. The forward active current from transistor M7 provides a current to flow through M1. This current flowing through M1 causes the circuit to move to the desired equilibrium point. The gate voltage for M3 and M4 drops from $V_{DD}$ resulting in a forward active current in M3 that contributes to the current flow through transistor M1. Approaching the desired equilibrium point causes the source voltage of M7 to increase causing the current through M7 to decrease. At the desired equilibrium point, the current through M3 is essentially the current through M1.

FIG. 2 is another version of the reference circuit 100 of FIG. 1 which instead uses a base-emitter junction voltage $V_{BE}$ of a bipolar junction transistor (BJT) as the reference regulator 236 to reference the desired electrical characteristic of a voltage or a current.

In FIG. 2, circuit 200 comprises a base-emitter voltage-referenced circuit 220, and start-up circuit 210. (See, for example, Allen & Holberg, CMOS Analog Circuit Design, p. 240–251, Holt, Rinehart & Winston, New York 1987, which is hereby incorporated by reference).

The reference circuit 220 comprises a current mirror 234 including p-channel field effect transistors (FETs) M3 and M4, n-channel FETs M1 and M2, a reference regulator 236 implemented in this example as a bipolar junction transistor Q1 and a reference output regulator 238 implemented in this example as a resistance R.

The sources of p-channel transistors M3 and M4 are connected to positive voltage supply $V_{DD}$. The drain of transistor M3 is connected to the gates of n-channel transistors M1 and M2 and also to the drain of n-channel transistor M1. The drain of p-channel transistor M4 is connected to the drain of n-channel transistor M2, and also to the gates of transistors M3 and M4. The gates of transistors M3 and M4 are connected together so that the output voltage $V_{XP}$ is supplied to the gates.

Similarly, the drain of n-channel transistor M1 is connected to the drain of M3 as illustrated (See $V_{XN}$) and also to the gates of n-channel transistors M1 and M2. The source of n-channel transistor M1 is connected to the emitter of bipolar transistor Q1. The base and collector of Q1 are connected to a ground $V_{SS}$. The source of transistor M2 is connected to one side of resistance R. Another side of resistance R is connected to ground $V_{SS}$.

The p-channel transistors and the n-channel transistors form a feedback circuit which causes reference current $I_1$ to be about equal to mirrored output current or bias current $I_2$. The p-channel transistors M3 and M4 may also be described as a current mirror 234 supplying a reference current and its mirrored output to a current source comprising the configuration of the n-channel FETs M1 and M2, BJT Q1 and R. The current source provides a supply independent output or bias electrical characteristic.

In post-start-up operation, the p-channel transistors M3 and M4 are assumed to be matched devices forming a current mirror unit 234 producing equal currents, $I_1$ and $I_2$, to flow from the drains of M3 and M4. The reference current $I_1$ activates the gates of n-channel transistors M1 and M2 so that the output current $I_2$ flows through transistor M2 creating the gate-source voltage $V_{GS2}$ and through resistance R creating a voltage $V=I_2R$. In this example, transistors M1 and M2 are n-channel transistors fabricated to have a positive threshold voltage. $I_1$ flows through transistor M1 creating the gate-source voltage $V_{GS1}$ and through BJT Q1 creating the base-emitter junction voltage $V_{BE}$. An equilibrium point is reached when the voltage $I_2R$ equals the base-emitter junction voltage $V_{BE}$ as illustrated by the equation:

$$I_2R+V_{GS2}=V_{BE1}+V_{GS1}$$

$$I_D = \frac{1}{2}K_p\frac{W}{L}(V_{GS}-V_t)^2$$

In saturation $$V_{GS} = V_t + \sqrt{\frac{2I_D}{K_p}\frac{L}{W}}$$

$V_t$ is the threshold voltage required to activate either of the FETs M1 or M2, and $I_D$ is the drain current of FET M1 or M2 in saturation.

Since $I_1=I_2$, then $V_{GS1}=V_{GS2}$, then $$I_2R = V_{BE1} = V_T\ln\left(\frac{I_1}{I_S}\right) \text{ or } I_2R = V_{BE1} = V_T\ln\left(\frac{I_2}{I_S}\right)$$

where $$V_T = \frac{kT}{q}$$

is the thermal voltage and $I_S$ is the saturation current of Q1.

The current is set by the voltage on R matching the voltage drop $V_{BE1}$ across the base-emitter junction of Q1.

As with the circuit in FIG. 1, there are two problems with this circuit: In addition to a desired equilibrium or stable operating point, an undesired second stable point exists at $I_2=I_1=0$. If $V_{XN}=0$ V and $V_{XP}=5$ V no current will flow. In order to prevent the circuit from operating at the undesired equilibrium point at $I_1=I_2=0$, a start-up circuit 210 is required. Start-up circuit 210 has the same configuration as the startup circuit example 110 except that the source of M7 is connected to both the gates of n-channel transistors M1 and M2. The current from M7 provides a current to both M1 and M2 to activate them and move operation of the reference circuit to the desired non-zero current equilibrium point Q. As in FIG. 1, as the source voltage of M7 increases, the current through M7 decreases so that M1 has essentially the same current $I_1$ as M3, and M2 has essentially the same current $I_2$ as M4 at the desired equilibrium point Q.

The second point is that the circuit requires $V_{DD}$ to be greater than the drop across $V_{BE}$ plus the threshold voltage $V_t$ of the n-channel FETs M1 and M2 before $V_{XP}$ is a stable bias voltage.

It is highly desirable that a reference circuit avoid a second undesired stable operating point at which $I_1=I_2$=zero. In this way, a startup circuit may be eliminated, thereby reducing chip size in integrated circuits and decreasing the power required to power a startup circuit. Furthermore, it is also desirable that the threshold voltage $V_t$ associated with the n-channel FETs not increase the voltage requirement of $V_{DD}$ in order to provide lower power implementations.

SUMMARY OF INVENTION

The present invention provides embodiments of a self-starting reference circuit for providing a reference electrical characteristic. In one embodiment in accordance with the present invention, the self-starting reference circuit comprises a current mirror including a first p-channel field effect transistor (FET) and a second p-channel FET configured to supply a reference current across the first FET and a mirrored output current across the second FET. Each p-channel FET has a gate, a source and a drain wherein the gates of these FETs are connected, the sources are connected to a power supply, and the drain of the second FET is connected to the gates of these FETs. This circuit embodiment further comprises a current source including a first n-channel FET which is a low-threshold n-channel FET having a source, a gate and a drain. The gate of the low-threshold FET is connected to the drain of the first p-channel FET, and the drain of the low-threshold n-channel FET is connected to the drain of the second p-channel FET. The current source further includes a reference regulator circuit for receiving the reference current from the drain of the first p-channel transistor and a reference output circuit for receiving the mirrored output current flowing from the source of the low-threshold n-channel FET and outputting a reference electrical characteristic.

In a more detailed embodiment in accordance with the present invention, the self-starting reference circuit described further comprises a second low-threshold n-channel FET having a gate, a source and a drain. Its drain is connected to the drain of the first p-channel transistor and to its own gate. Its gate is also connected to the gate of the first low-threshold FET, and its source connected to the reference regulator circuit. In this embodiment, the reference regulator circuit comprises a bipolar junction transistor (BJT) having an emitter, a base and a collector. The emitter being coupled to the source of the second low-threshold voltage n-channel FET, and the collector and base being coupled to a ground. Additionally, the reference output circuit comprises a resistance coupled between the source of the first low-threshold transistor and ground.

In yet another embodiment in accordance with the present invention, the reference regulator circuit comprises a positive threshold voltage n-channel FET having a gate, source and drain. Its drain is connected to the drain of the first p-channel transistor, its gate is connected to the source of the low-threshold FET, and its source is coupled to a ground. Also, in this embodiment, the reference output circuit comprises a resistance coupled between the source of the low-threshold transistor and ground.

Examples of low-threshold FETs are ones having gate threshold voltages about zero and ones having gate threshold voltages that are slightly negative. One example of a range of values qualifying as being about zero are from −0.1 V to 0.3V. An example of slightly negative is approximately −0.1V.

DETAILED DESCRIPTION OF THE DRAWINGS

Figure 2:
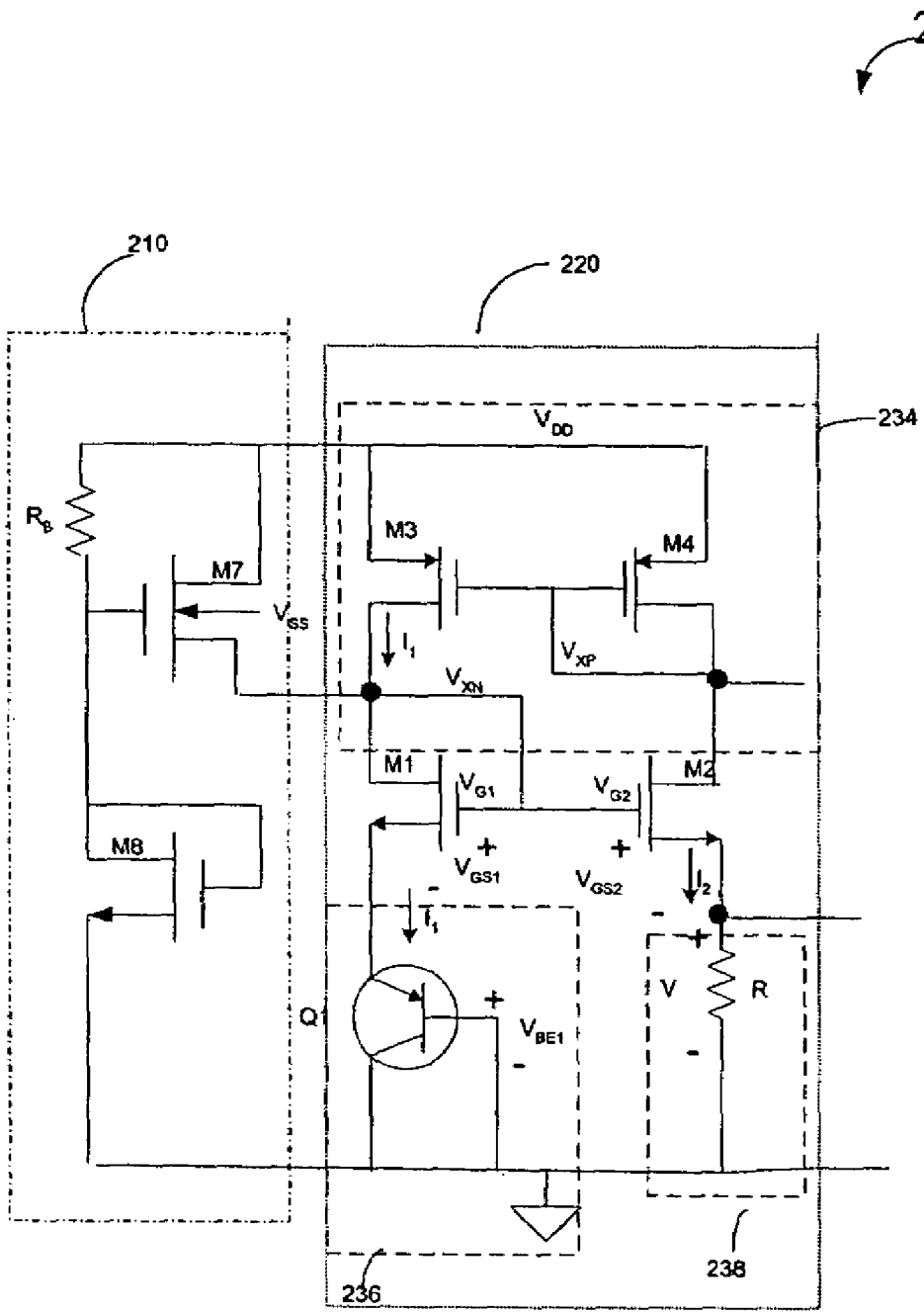
FIG. 2 (Prior Art)
FIG. 2 is a schematic circuit diagram that illustrates a conventional reference circuit including a base-emitter junction voltage $V_{BE}$ to reference a voltage or current and requiring a start-up circuit.
Figure 3:
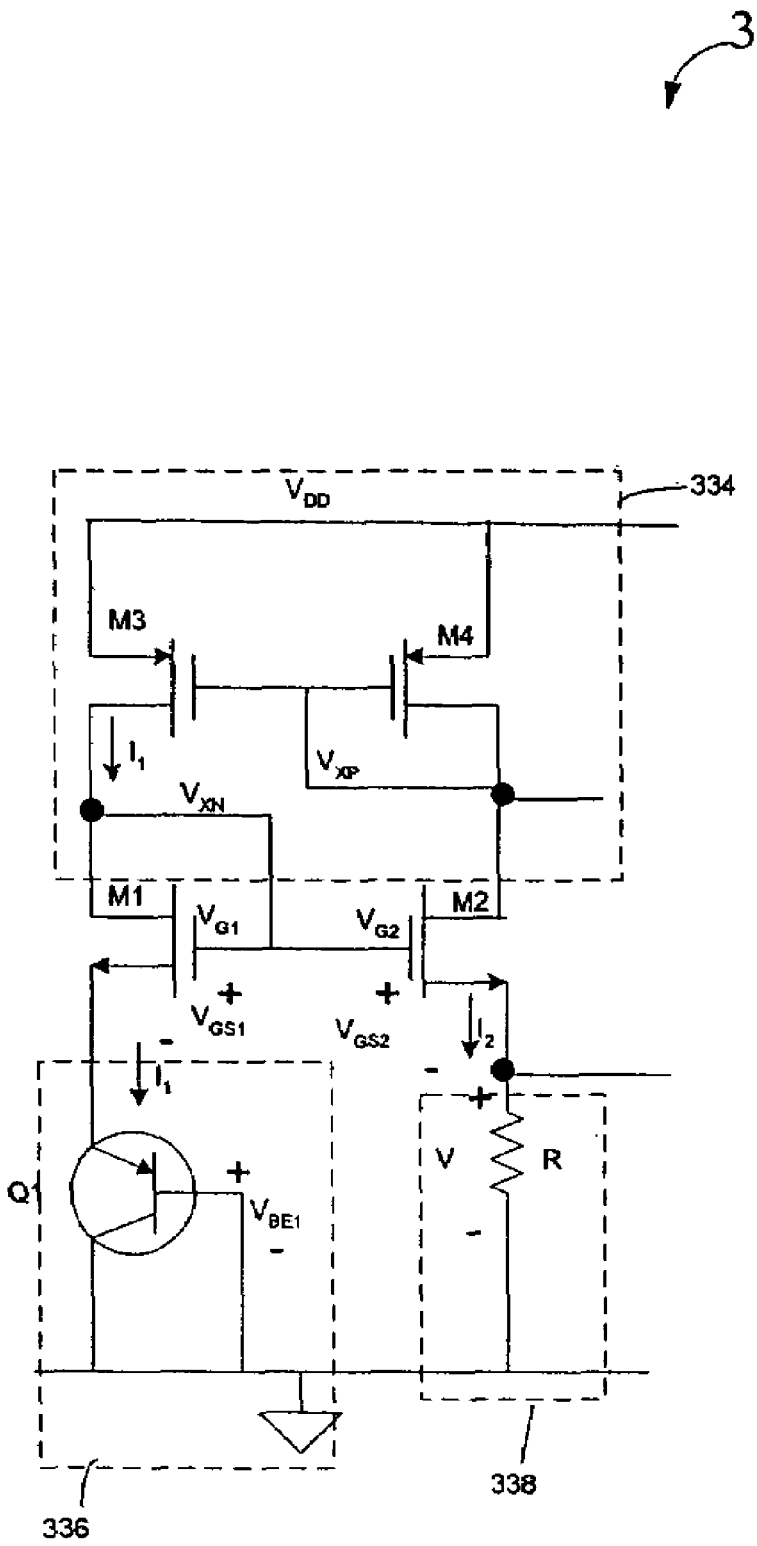
FIG. 3 is a schematic circuit diagram that illustrates a self-starting reference circuit using a BJT in accordance with an embodiment of the present invention.

FIG. 3 illustrates a self-starting reference circuit 300 including a BJT in accordance with an embodiment of the present invention. The circuit comprises a current mirror 334 including p-channel field effect transistors (FETs) M3 and M4, and a current source including a low-threshold n-channel FET M1 and a low-threshold n-channel FET M2, a reference regulator 336 implemented in this example as a bipolar junction transistor Q1 and a reference output regulator 338 implemented in this example as a resistance R. The elements are connected as discussed with respect to reference circuit 220 in FIG. 2. However, unlike in FIG. 2, the low-threshold FETs M1 and M2 are always "ON" meaning they operate in a forward active state. Because the gate threshold voltage of each of low-threshold FETs M1 and M2 is about zero or slightly negative, each is never completely turned off in the illustrated embodiment. Because the low-threshold FETs M1 and M2 are always active, even if the gates of p-channel FETs M3 and M4 are pulled high, some current would leak through M1 and M2 keeping them active so currents $I_1$ and $I_2$ flow through M1 and M2 respectively causing them to move toward saturation at the non-zero current equilibrium point Q (See FIG. 5). The reference current $I_1$ flows through M1 and generates voltage $V_{GS1}$. The mirrored current $I_2$ flows through M2, and a voltage V is generated across R which can be output as a bias voltage. The smaller $V_{G2}$ results in a larger $V_{G1}$ which activates the gate of M1 causing operation of M1 to move toward the non-zero current equilibrium point Q.

Figure 1:
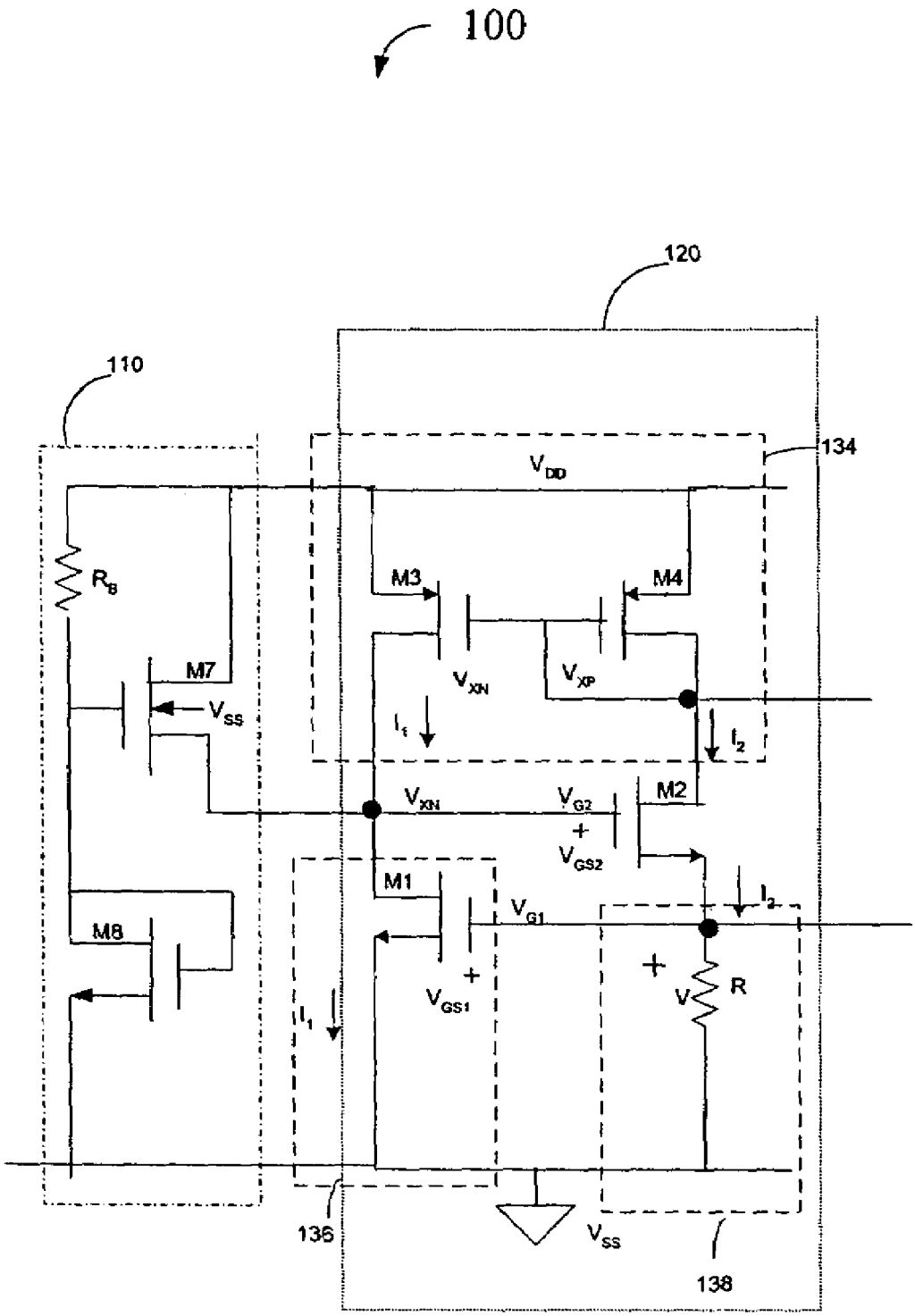
FIG. 1 (Prior Art)
FIG. 1 is a schematic circuit diagram that illustrates a version of a conventional reference circuit using all FETs and requiring a start-up circuit.

By using low-threshold FETs for n-channel transistors M1 and M2, both problems outlined above, i.e. the failure of the circuit to start at zero current and the high $V_{DD}$ required for normal operation, can be eliminated without any additional circuitry such as the start-up circuits 110 and 210 of FIGS. 1 and 2. This embodiment facilitates smaller circuit layout and lower operating current in the absence of a startup circuit that consumes both space and current which savings is particularly useful for small, low-power applications. Furthermore, because $V_{DD}$ must be greater than $V_{BE}$ plus the gate threshold voltage of the FET, a lower gate threshold voltage reduces the requirement of $V_{DD}$ which allows for lower voltage implementations. Additionally, this circuit embodiment may be implemented as an integrated circuit using CMOS technology and is particularly suited to analog CMOS integrated circuits. The circuit may also be implemented in Bi-CMOS.

Figure 4:
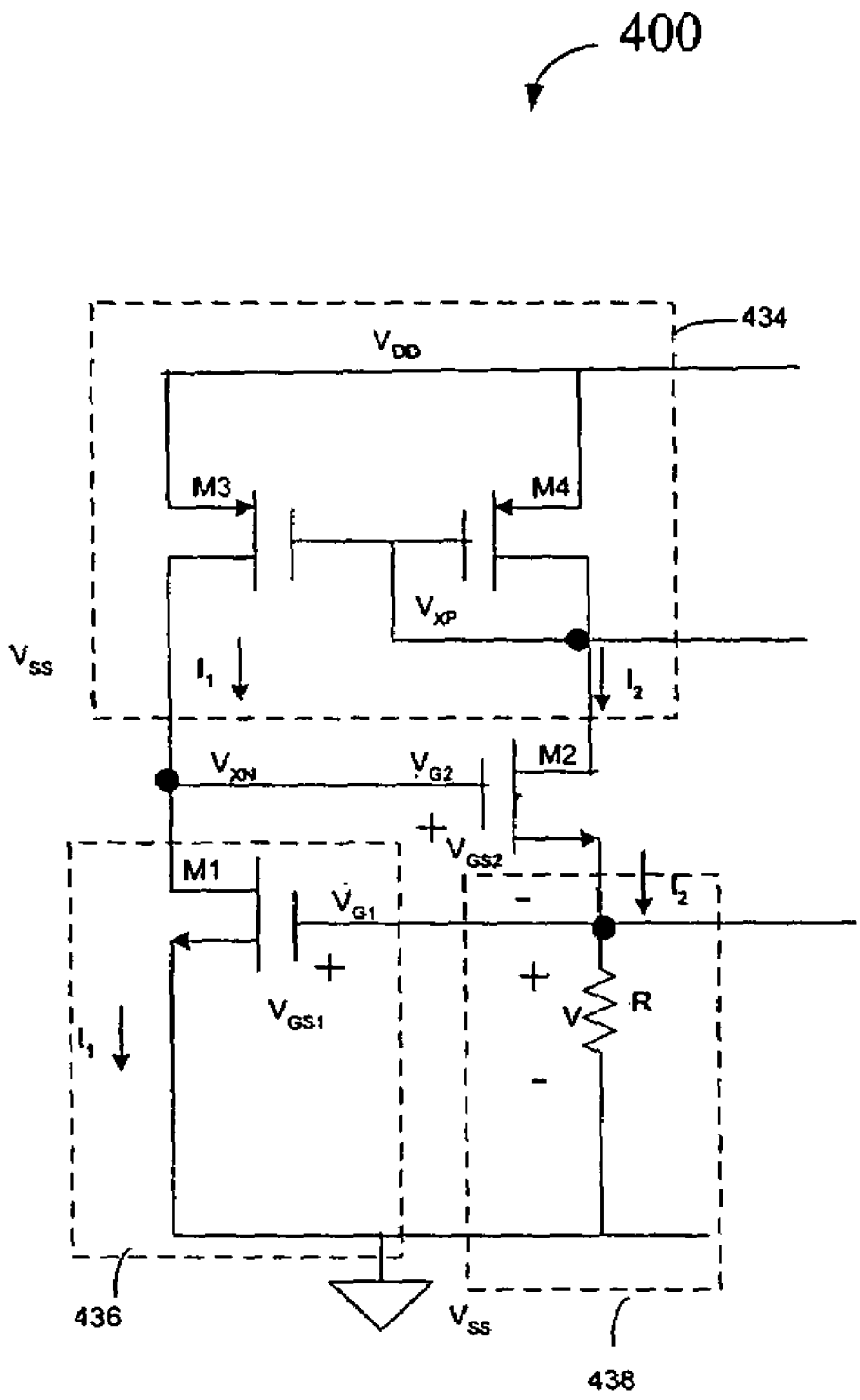
FIG. 4 is a schematic circuit diagram that illustrates a self-starting reference circuit using all FETs in accordance with another embodiment of the present invention.

FIG. 4 is a schematic circuit diagram that illustrates a self-starting reference circuit 400 using all FETs in accordance with another embodiment of the present invention. The reference circuit 400 comprises a current mirror 434 including p-channel field effect transistors (FETs) M3 and M4, n-channel FETs M1 and M2 wherein M1 is a FET with a positive threshold voltage, and M2 is a low-threshold gate voltage n-channel FET, a reference regulator 436 implemented in this example as an n-channel FET M1 and a reference output regulator 438 implemented in this example as a resistance R. The elements are connected as discussed with respect to reference circuit 120 in FIG. 1. However, unlike in FIG. 1, the low-threshold FET M2 is always "ON" meaning it is operating in a forward active state due to its gate threshold voltage being about zero or slightly negative. Again, M2 is never completely turned off so that even if the gates of p-channel FETs M3 and M4 are pulled high, some current would leak through M2 and generate an output reference voltage V across resistance R which activates the gate of FET M1 bringing M1 into forward active operation and bringing the whole circuit into normal operation at the non-zero current desired equilibrium point Q (See FIG. 5). Additionally, this circuit embodiment may be implemented as an integrated circuit using CMOS technology and is particularly suited to analog CMOS integrated circuits. This embodiment also benefits in not requiring a start-up circuit such as the examples 110 and 210 illustrated in FIGS. 1 and 2. Furthermore, $V_{DD}$ may be a lower supply voltage because of the low threshold gate voltage of M2.

In one implementation example, the low-threshold FETs are of the type known as natural NMOS FETs, or zero FETs. These type of FETs are commercially available, for example, from X-FAB™. X-FAB™ manufactures these FETs using a n-well process that produces them without a threshold adjustment implant so that they have a slightly negative gate threshold voltage.

For the circuit shown in FIG. 3, the following analysis solves for $V_{G1}$ as a function of $V_{G2}$. In this analysis S represents W, the depletion region width, divided by L, the length of the depletion region:

$$S = \frac{W}{L}.$$

$$V_{G2}=I_2R+V_{GS2}$$

$$V_{GS2}=V_{G2}-I_2R \tag{1}$$

$$I_2 = \frac{1}{2}K_{PN}S_2(V_{GS2} - V_{TN})^2 \tag{2}$$

By substituting equation (1) into equation (2), $$I_2 = \frac{1}{2}K_{PN}S_2(V_{G2} - I_2R - V_{TN})^2$$

$$\frac{1}{2}K_{PN}S_2R^2I_2^2 - [K_{PN}S_2(V_{G2} - V_{TN})R + 1]I_2 + \frac{1}{2}K_{PN}S_2(V_{G2} - V_{TN})^2 = 0 \tag{3}$$

$$a = \frac{1}{2}K_{PN}S_2R^2 \tag{4}$$

$$b = -[1 + K_{PN}S_2(V_{G2} - V_{TN})R]$$

$$c = \frac{1}{2}K_{PN}S_2(V_{G2} - V_{TN})^2$$

$$I_2 = \frac{-b \pm \sqrt{b^2 - 4ac}}{2a}$$

$$I_1 = \frac{S_3}{S_4}I_2 \tag{5}$$

$$V_{G1}=V_{BE1}+V_{GS1} \tag{6}$$

$$V_{BE1} = \frac{kT}{q}\ln\left(\frac{I_1}{I_S}\right) \tag{6a}$$

$$V_{GS1} = V_{TN} + \sqrt{\frac{2I_1}{K_{PN}S_1}} \tag{6b}$$

Substituting equations 6(a) and 6(b) into equation 6 and equation 5 for $I_1$ results in the following equation:

$$V_{G1} = \frac{kT}{q}\ln\left(\frac{I_2}{I_S}\frac{S_3}{S_4}\right) + V_{TN} + \sqrt{\frac{2I_1}{K_{PN}S_1}\frac{S_3}{S_4}} \tag{7}$$

It should be noted from equations 3 and 7 that the gate voltage across FET M1, $V_{G1}$, is expressed in terms of the following variables: $V_{G1}=f(S_3, S_4, I_S, K_{PN}, S_2, R, V_{G2}, V_{TN}, S_1)$. The variables are fixed by process or design except for the gate voltage for FET M2, $V_{G2}$. As illustrated by the following Table 1, created using the parameters shown, the circuit of FIG. 3 is self-starting because even at 0V, $V_{G2}$ activates the gate of M2 so that current $I_2$ flows through M2 causing it to move toward saturation at the non-zero current equilibrium point Q, but also the small initial $V_{G2}$ results in a larger $V_{G1}$ which activates the gate of M1 so that $I_1$ flows through M1 causing operation of M1 to move toward the non-zero current equilibrium point Q. These results indicated below illustrate a loop gain greater than one (1).

Parameters:

$$\frac{S_3}{S_4} = 1;$$

$I_S=3.5\times10^{-16}$ A; $K_{PN}=41\times10^{8}$ A/V$^2$; $V_{TN}$=0V; $S_2$=2; R= 1420 kilohms; and $S_1$=2.

TABLE 1

| $V_{G2}$ (volts) | $V_{G1}$ (volts) |
|---|---|
| 0 | 0.465 |
| 0.1 | 0.555 |
| 0.2 | 0.586 |
| 0.3 | 0.609 |
| 0.4 | 0.626 |
| 0.5 | 0.641 |
| 0.6 | 0.654 |
| 0.7 | 0.666 |
| 0.8 | 0.677 |
| 0.9 | 0.687 |
| 1.0 | 0.696 |
| 2.0 | 0.767 |
| 3.0 | 0.819 |
| 4.0 | 0.861 |
| 5.0 | 0.898 |

Figure 5:
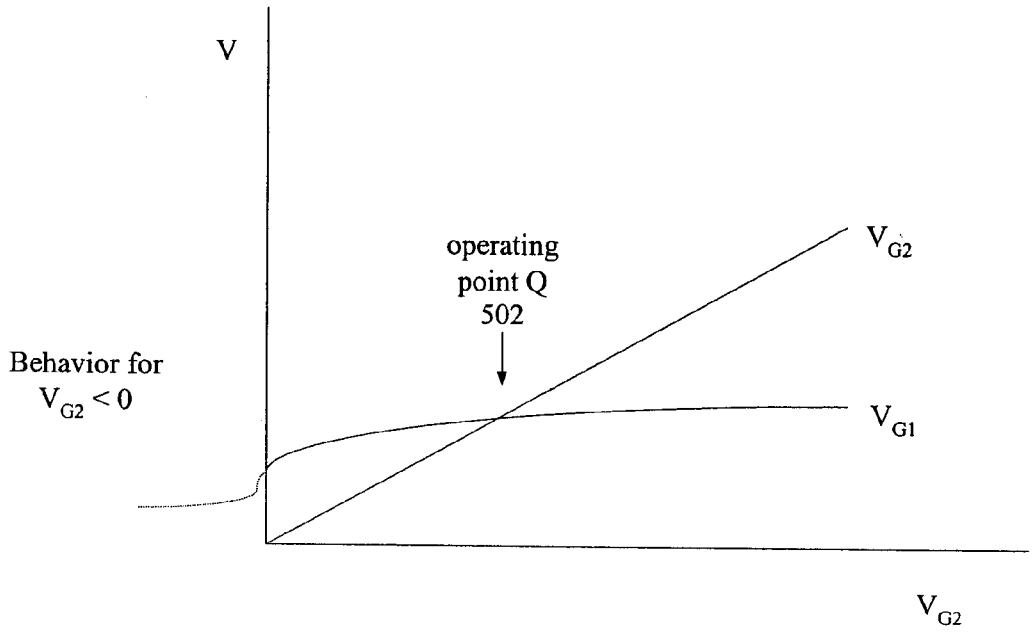
FIG. 5 is a graph that illustrates the behavior of the self-starting threshold-reference circuit embodiment of FIG. 3 which lack a zero current equilibrium operating point.

Furthermore, there is only the desired stable operating point 502 at other than zero current as shown by the behavior illustrated in the graph of FIG. 5. This graph illustrates the behavior of the self-starting threshold-reference circuit embodiment of FIG. 3 as having only one non-zero equilibrium operating point. Behavior for $V_{G2}<0$ was verified with SPICE. The use of the low-threshold FET in the embodiment illustrated in FIG. 4 would also have one non-zero current equilibrium operating point.

The present invention also provides a method for operating a self-starting reference circuit for providing a reference electrical characteristic in accordance with an embodiment of the invention. Consider the embodiments of a self-starting reference circuit including the circuit mirror as illustrated in FIGS. 3 and 4 discussed above and a current source including a low-threshold n-channel FET having its gate connected to the drain of the first p-channel FET and its drain connected to the drain of the second p-channel FET. The current source further includes a reference regulator circuit for receiving the reference current from the drain of p-channel transistor M3 and a reference output circuit for receiving the mirrored output current flowing from the source of the low-threshold n-channel FET and outputting a reference electrical characteristic such as a bias current or a voltage. A method for operating a self-starting reference circuit may be described for illustrative purposes in the context of these embodiments. The low-threshold FET generates a current across its transistor resulting in generating a voltage across the reference output circuit which in turn generates a voltage across the reference regulator. The generation of the voltage across the reference output circuit provides a differential voltage between the power supply $V_{DD}$ and the gates of the p-channel transistors causing forward active operation of the p-channel transistors. Similarly, the generation of the voltage across the reference regulator also provides such a differential voltage between $V_{DD}$ and the gates of the p-channel transistors.

What is claimed is:

1. A self-starting reference circuit for providing a reference electrical characteristic comprising:

a current mirror including a first p-channel field effect transistor (FET) and a second p-channel FET configured to supply a reference current across the first FET and a mirrored output current across the second FET, each p-channel FET having a gate, a source and a drain wherein the gates of these FETs are connected, the sources are connected to a power supply, and the drain of the second FET is connected to the gates of these FETs; and a current source including a first n-channel FET which is a low-threshold n-channel FET having a source, a gate and a drain, the gate of the low-threshold FET having a gate threshold voltage and being connected to the drain of the first p-channel FET and the drain of the low-threshold n-channel FET being connected to the drain of the second p-channel FET, the current source further including a reference regulator circuit for receiving the reference current from the drain of the first p-channel transistor and a reference output circuit for receiving the mirrored output current flowing from the source of the first low-threshold n-channel FET and outputting a reference electrical characteristic.

2. The self-starting reference circuit of claim 1 wherein the gate threshold voltage is about zero volts.

3. The self-starting reference circuit of claim 1 wherein the gate threshold voltage is slightly negative.

4. The self-starting reference circuit of claim 1 wherein the circuit is implemented in complementary metal-oxide semiconductor (CMOS).

5. The self-starting reference circuit of claim 1 wherein the circuit is implemented in analog CMOS.

6. The self-starting reference circuit of claim 1 wherein the low-threshold FET lacks a positive threshold voltage implant.

7. The self-starting reference circuit of claim 1 further comprises a second low-threshold n-channel FET having a gate, a source and a drain, its drain connected to the drain of the first p-channel transistor and to its own gate, its gate connected to the gate of the first low-threshold FET, and its source connected to the reference regulator circuit;

said reference regulator circuit comprises a bipolar junction transistor (BJT) having an emitter, a base and a collector, the emitter being coupled to the source of the second low-threshold n-channel FET and the collector and base being coupled to a ground; and said reference output circuit comprising a resistance coupled between the source of the low-threshold transistor and ground.

8. The self-starting reference circuit of claim 6 wherein the circuit is implemented in Bi-CMOS.

9. The self-starting reference circuit of claim 1 wherein said reference regulator circuit comprises a positive threshold voltage n-channel FET having a gate, source and drain, the drain connected to the drain of the first p-channel transistor, its gate connected to the source of the low-threshold FET, and its source being coupled to a ground; and said reference output circuit comprising a resistance coupled between the source of the low-threshold transistor and ground.

10. In a self-starting reference circuit for providing a reference electrical characteristic comprising a current mirror including a first p-channel field effect transistor (FET) and a second p-channel FET configured to supply a reference current across the first FET and a mirrored output current across the second FET, each p-channel FET having a gate, a source and a drain wherein the gates of these FETs are connected, the sources are connected to a power supply, and the drain of the second FET is connected to the gates of these FETs, and a current source including a low-threshold n-channel FET having a source, a gate and a drain, the gate of the low-threshold FET being connected to the drain of the first p-channel FET and the drain of the low-threshold n-channel FET being connected to the drain of the second p-channel FET, the current source further including a reference regulator circuit for receiving the reference current from the drain of the first p-channel transistor and a reference output circuit for receiving the mirrored output current flowing from the source of the low-threshold n-channel FET and outputting a reference electrical characteristic, a method for operating a self-starting reference circuit comprising:

the low-threshold FET generating a current across its transistor;

generating a voltage across the reference output circuit based on the current;

generating a voltage across the reference regulator based on the voltage across the reference output circuit; and providing a differential voltage between the power supply and the gates of the p-channel transistors causing forward active operation of the p-channel transistors.

* * * * *